US010927593B2

(12) United States Patent
Balthazor et al.

(10) Patent No.: US 10,927,593 B2
(45) Date of Patent: Feb. 23, 2021

(54) DOORS AND METHODS FOR REDUCING TELEGRAPHING THEREFOR

(71) Applicant: Masonite Corporation, Tampa, FL (US)

(72) Inventors: Kurt L. Balthazor, Pittsburg, KS (US); Michael J. Marvel, Pittsburg, KS (US); Dale W. Mayfield, Clearwater Beach, FL (US); Steven B. Swartzmiller, Batavia, IL (US)

(73) Assignee: Masonite Corporation, Tampa, FL (US)

( * ) Notice: Subject to any disclaimer, the term of this patent is extended or adjusted under 35 U.S.C. 154(b) by 0 days.

(21) Appl. No.: 16/176,154

(22) Filed: Oct. 31, 2018

(65) Prior Publication Data

US 2020/0123842 A1 Apr. 23, 2020

Related U.S. Application Data

(60) Provisional application No. 62/748,116, filed on Oct. 19, 2018.

(51) Int. Cl.

| | |
|---|---|
| ***E06B 3/70*** | (2006.01) |
| ***E06B 3/72*** | (2006.01) |
| ***E06B 3/76*** | (2006.01) |

(52) U.S. Cl.

CPC ..... *E06B 3/725* (2013.01); *E06B 3/76* (2013.01); *E06B 3/7001* (2013.01); *E06B 2003/704* (2013.01); *E06B 2003/7023* (2013.01); *E06B 2003/7059* (2013.01)

(58) Field of Classification Search

CPC ..... E06B 3/725; E06B 3/76; E06B 3/7001; E06B 3/7015; E06B 3/723; E06B 3/822; E06B 3/825; E06B 2003/704; E06B 2003/7023; E06B 2003/7059; E06B 2003/703; E06B 2003/7061; E06B 2003/7063; E06B 2003/7069; E06B 2003/7084

See application file for complete search history.

(56) References Cited

U.S. PATENT DOCUMENTS

| | | | | |
|---|---|---|---|---|
| 2,839,792 | A * | 6/1958 | Sanders | E06B 3/825 428/120 |
| 4,327,535 | A | 5/1982 | Governale | |
| 5,285,608 | A * | 2/1994 | Costello | E06B 3/7001 52/309.11 |
| 5,644,870 | A * | 7/1997 | Chen | E06B 3/7001 49/501 |
| 5,887,398 | A | 3/1999 | Chen | |
| 5,914,078 | A | 6/1999 | Morrison | |
| 6,619,010 | B2 * | 9/2003 | Wang Chen | E06B 3/825 49/501 |

(Continued)

*Primary Examiner* — Jessica L Laux

(74) *Attorney, Agent, or Firm* — Berenato & White, LLC

(57) ABSTRACT

This invention relates to doors having internal blocking components that reduce or eliminate telegraphing of the outer surface of the door facings. In particular, the invention relates to steel-edge steel doors that have internal solid wood blocks that have one or more integral cantilever beams formed into the blocks to interact with the adjoined oppositely arranged door facings in order to eliminate visually apparent door telegraphing. The blocks are modified to contain notches formed therein to form the cantilever beams.

10 Claims, 7 Drawing Sheets

(56) References Cited

U.S. PATENT DOCUMENTS

| | | | |
|---|---|---|---|
| 9,016,030 | B1 | 4/2015 | Steele |
| 9,593,526 | B2 | 3/2017 | Chen |
| 9,816,313 | B2 | 11/2017 | Nelson |
| 2010/0139187 | A1 | 6/2010 | Medina et al. |
| 2014/0053489 | A1 | 2/2014 | Bryant et al. |

* cited by examiner

DOORS AND METHODS FOR REDUCING TELEGRAPHING THEREFOR

CROSS-REFERENCE TO RELATED APPLICATIONS AND CLAIM TO PRIORITY

This application is related to application No. 62/748,116, filed Oct. 19, 2018, the disclosure of which is incorporated herein by reference and to which priority is claimed.

FIELD OF THE INVENTION

This invention relates to doors having internal blocking components that reduce or eliminate telegraphing of the outer surface of the door facings. In particular, this invention relates to steel-edge steel doors that have internal solid wood blocks that have one or more integral cantilever beams formed into the blocks to interact with the adjoined oppositely arranged door facings in order to eliminate visually apparent door telegraphing.

BACKGROUND OF THE INVENTION

Lightweight construction panels, such as used in doors, are typically constructed of a frame forming an outer perimeter, door facings (sometimes called door skins) attached to opposing sides of the frame, and a lightweight core filling the space between the facings and the frame. Blocking components, typically made of wood, are incorporated at selected locations about the interior of the door, where additional structural support is desired, e.g. such as to provide structures to fasten or connect other components to the door or the entry system. The core is formed from a material that typically has different physical properties (e.g. tensile strength, thermal coefficient of expansion, etc.) than the block components, with the result that the door facings may deform at the intersection of the blocking components and the core. The deformation is believed to be due to differential thermal expansion between the core material and the material of the block components, or differential shrinkage occurring during processing of the door. Deformation may also be caused by loadings on the door in the area over the more compliant core, causing the core to compress more than the rigid blocking components. Visually noticeable deformation of the surface of a door facing, at the intersection of the core and blocking components below the surface, is referred to as telegraphing. Should the door facings be made of steel, then the deformation will usually be permanent. Telegraphing may cause a consumer to believe there is a defect in the door, thus reducing salability of the door or decreasing its aesthetic value.

While efforts have been made to minimize telegraphing, those efforts have not been completely successful. Therefore, there remains a need for lightweight construction panels, such as doors, that eliminate or reduce telegraphing.

SUMMARY OF THE INVENTION

A first aspect of the present invention relates to doors having blocking components that have at least two notches, such as kerfs, formed therein to form cantilever beams that reduce or eliminate telegraphing. The door contains a pair of opposed door facings secured to opposite sides of a peripheral door frame. A core and blocking components fill the internal cavity inside the frame and between the door facings. The blocking components contain notches, such as kerfs, formed in a surface thereof which extend approximately parallel to the major plane of the facings. In a preferred embodiment, the notches extend a substantial portion of the length (or width) of the blocks in parallel, and may be of differing or the same depth.

A further aspect of the present invention relates to steel-edge steel doors having core and a stile block in the internal cavity inside the frame and between the door facings. The stile block contains parallel notches, such as kerfs, extending through the width of the stile block and parallel to the major surface of the facings.

Other aspects of the invention, including methods, processes, systems, and the like which constitute part of the invention, will become more apparent upon reading the following detailed description of the exemplary embodiments.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. In the drawings.

DETAILED DESCRIPTION

Figure 1:
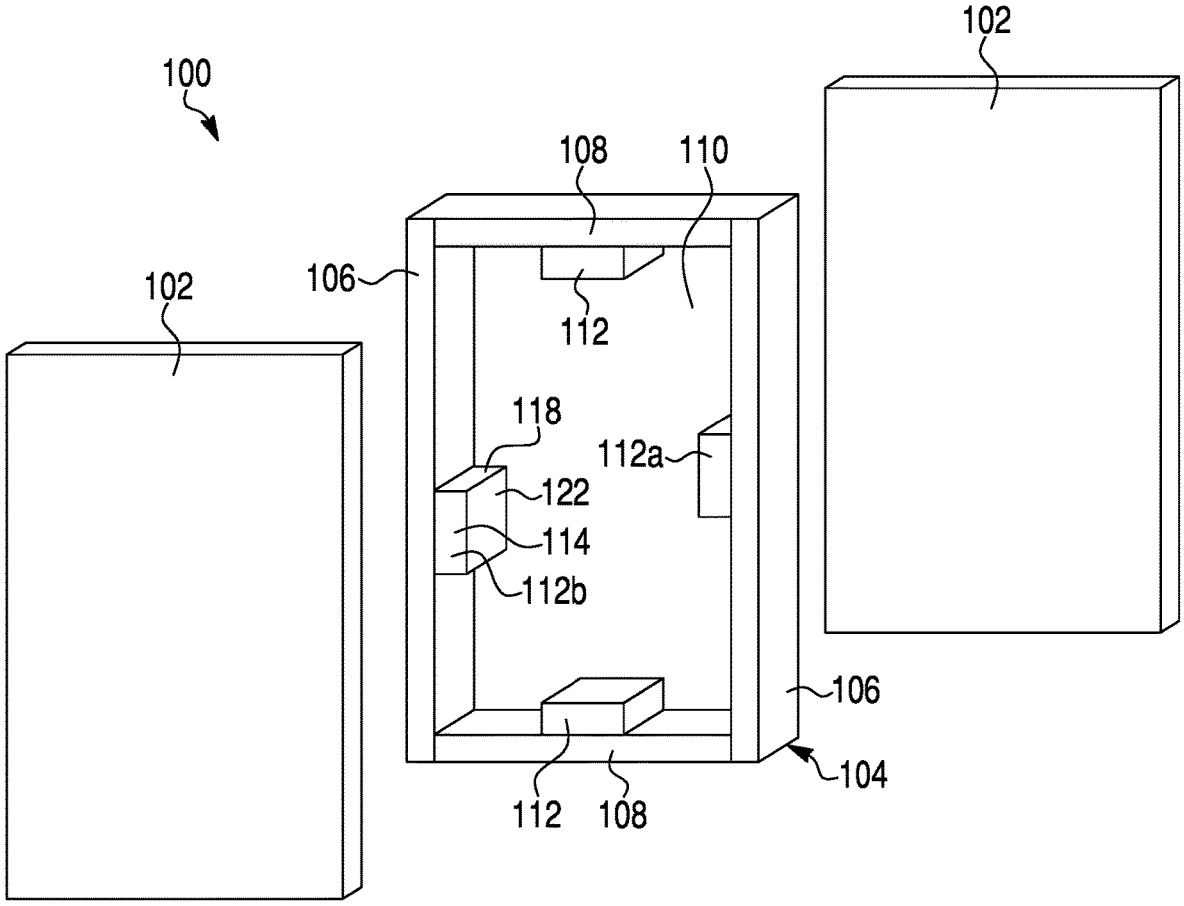
FIG. 1 shows an exploded view of a door.

Reference will now be made in detail to exemplary embodiments and methods of the invention. It should be noted, however, that the invention in its broader aspects is not necessarily limited to the specific details, representative materials and methods, and illustrative examples shown and described in connection with the exemplary embodiments and methods. Like reference characters refer to like parts throughout the drawings.

Figure 3:
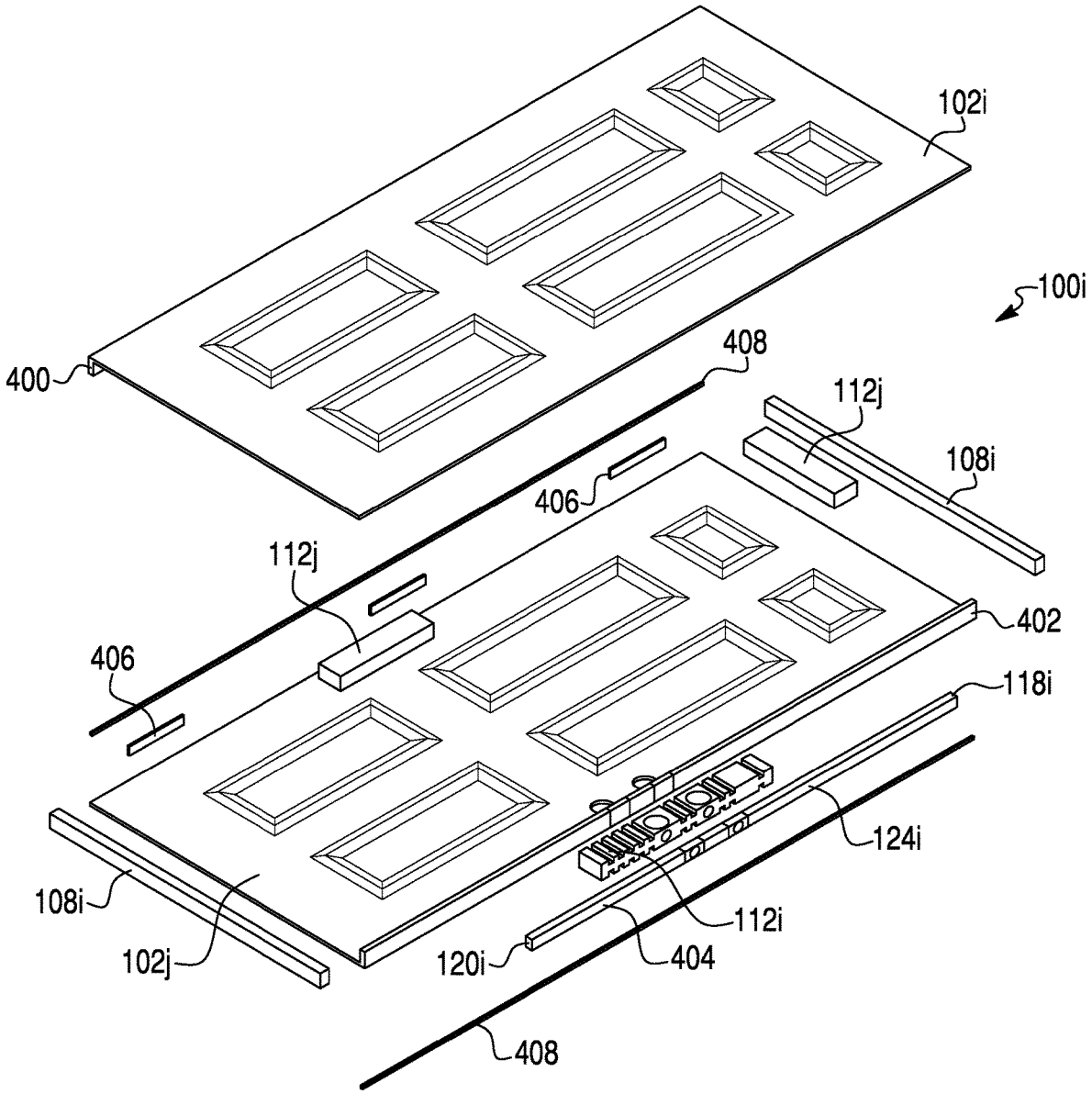
FIG. 3 is an exploded assembly view of a steel-edge steel door according to the invention.

A door 100, as best shown in FIG. 1, has a pair of opposed door facings 102 secured to opposite sides of a peripheral door frame 104. As is typical for cored doors, the door 100 is preferably supported by a rectangular frame 104 containing two parallel stiles 106 attached at their respective ends to two parallel rails 108. Door facings 102 are secured to opposite sides of the frame 104 to form the door 100. Although FIG. 1 depicts flush or flat door facings 102, the door facings 102 may contain one or more panels and/or design patterns formed in the door facings 102, as illustrated in FIG. 3. A core 110 fills the internal cavity inside the frame 104 and between the door facings 102. The core 110 may be formed from materials which include, but are not limited to, polyurethane foam, polystyrene foam, minerals, and cardboard.

In areas where reinforcement is needed, one or more blocking components 112 may be placed in the core. Those reinforcement areas may be, but are not limited to, areas for mounting locks and handles to the door (lock block 112*a*)

and for mounting hinges to the door (hinge block 112*b*). The blocking components 112 may be made of wood or polymeric materials, and preferably are solid wood.

Those skilled in the art recognize that the door facings 102 may be made from wood composite, polymer reinforced composite, such as fiber glass, and metals, such as steel. Telegraphing is a particular problem where the door facings 102 are made of steel. Likewise, the stiles 106 and the rails 108 are normally made of solid wood, although other materials may be used. The door facings 102 conventionally are secured to the frame 104 by adhesive, such as polyvinyl acetate (PVA), hot melt adhesive, or even from the foam frequently used for the core 110. Where the door facings 102 are made of steel, the frame 104 may require only rails 108.

Figure 2:
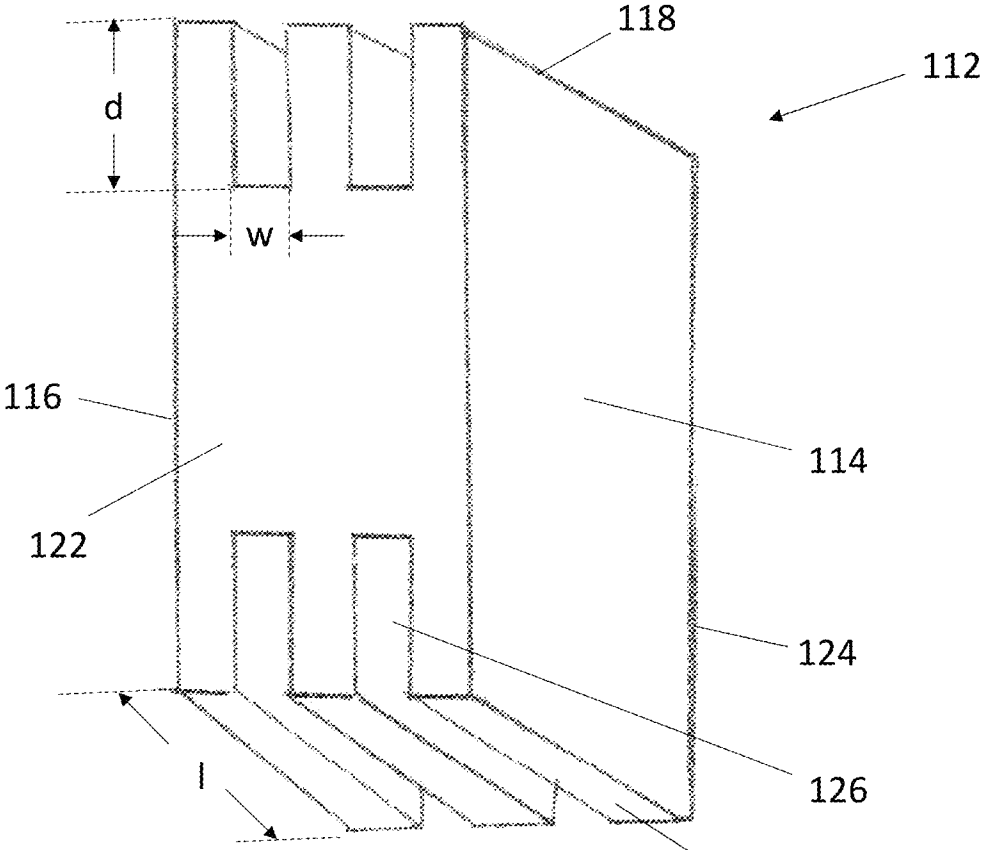
FIG. 2 is a perspective view of an exemplary blocking component having notches therein.

A blocking component 112 is shown in FIG. 2, and conventionally is a rectangular block mounted in the door 100 such that two of its opposing surfaces 114 and 116 are in contact with the opposed door facings 102 and preferably adhered thereto. The other four surfaces 118, 120, 122, and 124 of the block 112 are preferably in contact with the core 110, with the top surface 118 facing the top of the door 100, the bottom surface 120 facing the bottom of the door 100, the lock surface 122 facing the lock side of the door 100, and the hinge surface 124 facing the hinge side of the door 100. Typically a plurality of hinge blocks 112*b* are provided in spaced relation along the side of the door 100, each block 112*b* for connection to an associated hinge.

One or more of the blocking components 112 may be modified along the surfaces 118, 120, 122, and 124. Two or more notches 126, such as kerfs formed by saws, are formed into each blocking component 112 and extend along the surfaces 118, 120, 122, and 124 in a direction parallel to the plane of the door facings 102. As best shown in FIG. 2, notches 126 are formed into the top surface 118 and the bottom surface 120. Each of the notches 126 has a length l which extends a portion of the length (or width) of the blocking component 112 and are parallel to the plane of the door facings 102. In the case of door facings 102 having panels, such as illustrated in FIG. 3, the notches 126 extend parallel to the plane of the peripheral surface of the door facings 102. Preferably, each of the notches 126 has a depth, d, and a width, w. The depth d and the width w are sufficient to form a cantilever beam. Preferably, the depth, d, is about 4 in. to about 6 in. and the width, w, is about 0.094 in. to about 0.156 in., preferably about 0.125 in. The notches 126 may have the same or different depths. Preferably, the same depth is used for the notches 126.

Although FIG. 2 shows the notches 126 formed in the top surface 118 and the bottom surface 120, notches 126 may be formed in the lock surface 122 and the hinge surface 124. Preferably, notches 126 are formed in the opposing surfaces, e.g. the top and bottom surfaces 118 and 120, or lock and hinge surfaces 122 and 124. In preferred embodiments, two notches 126 are formed in each of top surface 118 and bottom surface 120, and no notches are formed in the lock surface 122 and the hinge surface 124. The notches 126 extend in parallel to each other. The notches may have a uniform depth or different depths. Preferably, a uniform depth is used. The notches 126 preferably have a rectangular shape, such as may be achieved through use of a saw. In certain embodiments, the core may fully or partially fill the notches 126; however, that is not essential for the present invention.

Telegraphing has been a particular problem at the end of the stile block that is installed along the latch stile of steel-edge steel doors to provide additional structural support. Because the wood stile blocks are more rigid (higher modulus of elasticity) than the polyurethane foam core, a permanent deformation may be formed in the steel face of doors directly over the intersection of the stile block and foam when a load is placed on the face of the door. For example, such permanent deformation can occur on the doors toward the bottom of a pallet of doors which has multiple of doors stacked thereon.

While not wishing to be bound by any theory, it was found that cutting kerfs or notches in the stile block parallel to the door facings 102, and at an appropriate spacing from the door facings 102, creates a deformable cantilever beam near the edge of the stile block. The stile block can as a result deform in a gradual, controlled manner so the deformations of the associated door facings 102 are much less visible. The notches 126, such as leafs, formed by the saw resulted in a door construction that reduced telegraphing to an acceptable level or even eliminated it completely.

One's eye picks up a more abrupt change in light scattering angle associated with greater rate of change in slope of the door facing surface. By reducing the rate of slope change at the edge of the door facing near the stile block, the door facing can deform to a similar depression depth but not be as detectable visibly because the change in surface angle is more gradual. The gradual curvature of a "cantilever beam" is an efficient, effective, and novel way to address this problem.

In a preferred embodiment, door 100*i* is a steel-edge steel door, as best shown in FIG. 3. A steel-edge steel door, as understood in the art, is one where the facings 102 are formed from steel, such as a 24 gauge hot dipped galvanized steel, with the steel being pressed at an edge to form an edge for the door 100*i*. Each door facing 102*i* or 102*j* forms one of the edges 400 or 402, respectively, of the door 100*i*. The ends of the rails 108*i* abut the adjacently disposed edges 400 and 402 of the door facings 102*i* and 102*j*. With this construction, the typical peripheral frame is not needed, and the rails 108 are sufficient. The door facing 102*j* of FIG. 3 illustrates 6 panels formed in the door facing 102*j*, thus providing a paneled door.

The door 100*i* contains parallel rails 108*i* at the top and bottom of the door. The door 100*i* contains steel edges 400 and 402 that are sufficiently strong to support the door 100*i* without requiring conventional wood stiles. The steel edges 400 and 402 are formed from a perpendicular fold in their respective steel door facings 102*i* and 102*j*. For example, the hinge side steel edge 400 is formed by bending one edge of the outside door facing 102*i* approximately 90°; and the lock side steel edge 402 is from by bending one edge of the inside door facing 102*j* approximately 90°. Of course, the reverse, where the hinge side steel edge 400 is formed from the inside door facing 102*j* and the lock side steel edge 402 is formed from the outside door facing 102*i*, is also contemplated by the present invention. Thus, each of the door facings 102*i* and 102*j* contains a major surface and an edge extending approximately perpendicular from the major surface.

The door 100*i* also includes a lock block 112*i* for mounting of the door lock and/or the door handle. The lock block 112*i* may include one or more holes to facilitate such hardware mounting. When assembled, the holes in the lock block 112*i* are placed in registry with corresponding holes in the facings 102*i* and 102*j*. A solid wood stile block 404 is placed adjacent to the lock block 112*i* and between the lock block 112*i* and the lock side edge 402. The lock surface 122*i* of the stile block 404 is preferably in contact with the lock side edge 402 and overlaps a portion of the length of the lock side edge 402 (the stile block 404 is shorter than the lock side edge 402); and the hinge side surface 124*i* (opposing the lock surface 122*i* and facing the hinge side of the door 100*i*) is preferably in contact with the lock block 112*i*. The stile block 404 also contains surfaces 114*i* and 116*i*, which are in contact with the opposed major surfaces of the facings 102*i* and 102*j* (see FIGS. 5-6). The stile block 404 provides structural support for the attachment of a lockset and deadbolt hardware and may contain holes therefor.

The door 100*i* may also include other blocking components 112*j*, e.g. for attachment of door closure hardware, or steel reinforcements 406 for hinge mounting. The reinforcements 406 may be metallic plates attached to the inside of the hinge side edge 400 for attachment of hinges for mounting the door 100*i*.

Figure 7:
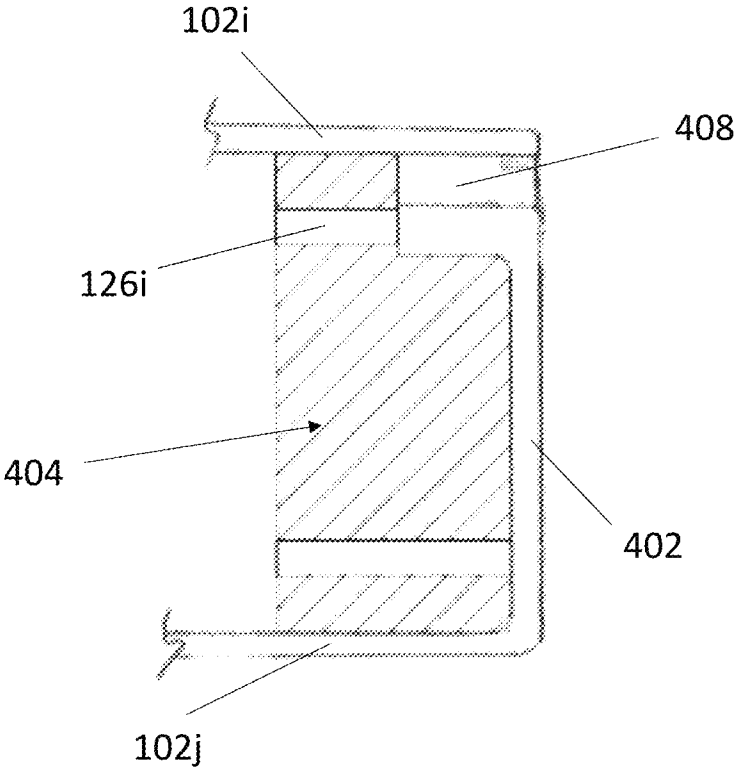
FIG. 7 is a cross-sectional view of stile block taken along the line 7-7 of FIG. 6.

Thermal barriers 408 are preferably used to prevent contact, and thus, thermal conduction between the door facings 102*i* and 102*j*. The thermal barriers 408 are preferably polymeric materials having low thermal conductivity and placed on the edges 400 and 402 to prevent their direct contact with the opposing door facing 102*j* and 102*i*, respectively. Thus, a first thermal barrier 408 is placed between the hinge side edge 400 and the door facing 102*j* to prevent their physical contact; and a second first thermal barrier 408 is placed between the lock side edge 402 and the door facing 102*i* to prevent their physical contact (see FIGS. 3 and 7). The thermal barrier 408 prevents heat conduction from one door facing to the other.

Figure 4:
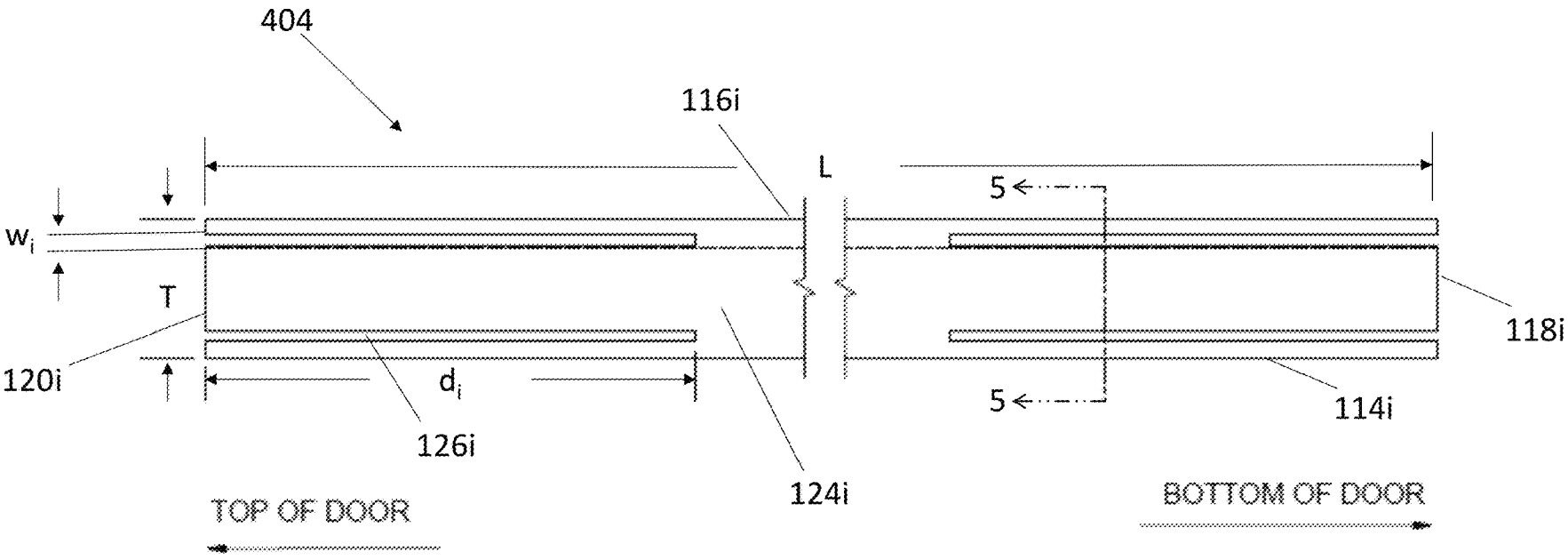
FIG. 4 is a fragmentary elevational view of a stile block having notches therein.
Figure 5:
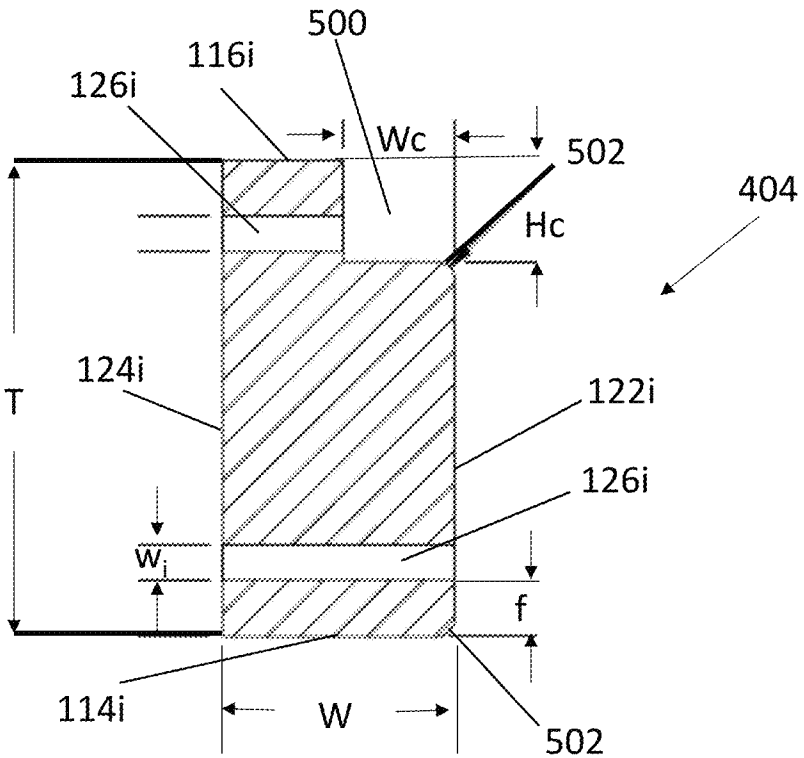
FIG. 5 is a cross-sectional view of stile block taken along the line 5-5 of FIG. 4.

As best illustrated in FIGS. 3-5, the stile block 404 contains notches 126*i*, such as kerfs, in its top surface 118*i* and bottom surface 120*i*, extending parallel to the major surface of the door facings 102*i* and 102*j*. Preferably, two or more notches 126*i* are present, most preferably two. The notches 126*i* are similar to those described above. The other blocking components 112*j* of the steel-edge steel door 100*i* may also include notches 126*i*; however, they are not necessary or are not necessary for all hardware blocking components. The stile block 404 contains notches 126*i* to prevent telegraphing in the steel-edge steel door 100*i*.

As best shown in FIGS. 4-5, the stile block 404 preferably has a length L of about 42 in. to about 53 in., a width W of about 0.8 in. to about 1.2 in., and a thickness of about 1.6 to about 1.7 in. The steel-edge steel door 100*i* most preferably has a stile block 404 of about 42.24 in., about 50.75 in., or about 52.5 in. in length, with a corresponding width W of about 0.813 in., about 1.18 in., or about 1.18 in., respectively. The thickness T of the steel-edge steel door 100*i* is preferably about 1.75 in. to about 1.80 in., thereby, yielding an inner cavity of preferably about 1.688 in.±0.008 in.

Preferably, each of the notches 126*i* has a width $w_i$ of about 0.094 in. to about 0.156 in., preferably about 0.125 in., and a depth $d_i$ of about 4 in. to about 6 in., preferably about 5.5 in. In certain embodiments, the notches 126*i* may have the same or different depths (see FIG. 6) and/or or widths. Preferably, the same depth $d_i$ and/or width $w_i$ are used in the stile block 404. The notches 126*i* are preferably located at a distance f from the surfaces 114*i* and 116*i* (which are in contact with the opposed major surface of the facings 102*i* and 102*j*) of the stile block 404 (see FIG. 5). The distance f is about 0.200 in. to about 0.500 in., most preferably 0.200 in. Because the stile block 404 is in contact with the door facings 102*i* and 102*j*, each of the notches 126*i* is separate from its closest door facing 102*i* or 102*j* by distance f.

As best shown in FIGS. 4 (dashed line) and 5, the stile block 404 preferably contains a square or rectangular cutout section 500 along the length L of the stile block 404 at one of its edges. The cutout section 500 provides accommodation for the connection between the lock side edge 402 of the door facing 102*j* and the opposing door facing 102*i*, including the thermal barrier 408 therebetween (see FIG. 7). The cutout section 500 preferably extends the complete length L of the stile block 404 (see dashed line in FIG. 4) and cuts into the block 404 slightly past, preferably about 0.060 in. to about 0.070 in., one of the notches 126*i*. As shown in FIG. 5, the cutout section 500 is located at the intersection of surfaces 122*i* and 116*i*. The cutout 500 preferably has a width Wc and height Hc of about 20% to about 45% of the width W of the stile block 404. Most preferably, the cutout 500 has the same width Wc and height Hc of about 0.40 in.

As best shown in FIG. 4, the notches 126*i* extend in parallel to each other and only a portion of the length of the stile block 404. It can be seen in FIG. 4 that notches 126*i* extend in parallel from the top facing end 120*i* of the block 404 and also in parallel from the bottom facing portion 118*i*. In a preferred embodiment, the notches 126*i* extending from the top and bottom facing surfaces 120*i* and 118*i*, respectively are the same depth $d_i$, terminate in spaced relation from each other, and are longitudinally aligned. While we prefer that the top facing notches and bottom facing notches 126*i* be the same depth (see FIG. 4), they may have differing depths (see FIG. 6). Likewise, the top facing and/or bottom facing notches may themselves have different depths.

Figure 6:
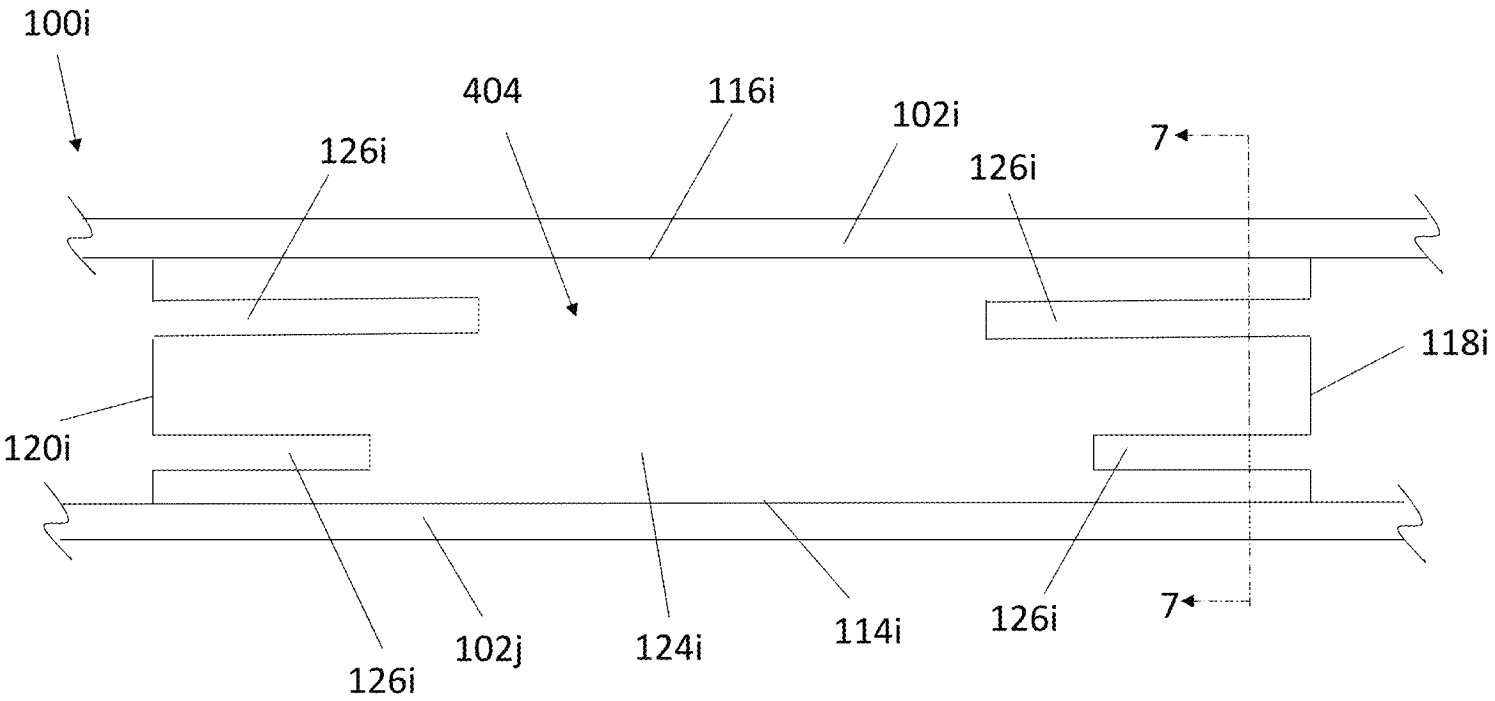
FIG. 6 is an elevational view of a stile block having notches of different lengths.

As best shown in FIG. 6, rounded edges 502 are also preferred features of the stile block 404. Preferably, the rounded edges 502 border the lock surface 122*i*. When assembled in the steel-edge steel door 100*i*, the rounded edges 503 conform to the fold(s) of the steel edge 402. Preferably, the rounded edges 504 have a radius of about 0.030 in. to about 0.095 in., most preferably about 0.063 in.

Although certain presently preferred embodiments of the invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by any appended claims and the applicable rules of law.

What is claimed is:

1. A steel-edge steel door, comprising:

a horizontally extending top rail;

a horizontally extending bottom rail;

first and second cooperating door facings positioned on opposing sides of the rails, each of the door facing having an edge extending perpendicularly to the rails and formed from steel;

a core disposed between the door facings; and a stile block adjacent to the edge of the door facings and positioned between the top and bottom rails, the stile block having a first end facing the top rail, a second end facing the bottom rail, and a length less than the length of the edge of the door facings, wherein the stile block has at least two first parallel notches extending from the first end away from the top rail, and at least two second parallel notches extending from the second end away from the bottom rail, the first and second parallel notches terminate remote from each other.

2. The steel-edge steel door of claim 1, wherein the stile block extends a portion of the length of the associated edge.

3. The steel-edge steel door of claim 2, further comprising a lock block, the stile block disposed between to the lock block and the edge.

4. The steel-edge steel door of claim 1, wherein the notches extend parallel to each other and to the door facings.

5. The steel-edge steel door of claim 1, wherein the notches extending from the first and second ends have a uniform length.

6. The steel-edge steel door of claim 5, wherein the notches have a uniform width.

7. The steel-edge steel door of claim 1, wherein the notches extending from the first and second ends are longitudinally aligned.

8. The steel-edge steel door of claim 7, wherein the stile block contains a cutout section along its length at an edge thereof, and one of the notches extends along the cutout section.

9. The steel-edge steel door of claim 8, wherein the cutout section comprises a width and a height of about 20% to about 45% of the width of the stile block.

10. The steel-edge steel door of claim 1, wherein the core comprises one of polyurethane foam, polystyrene foam, minerals, or cardboard.

* * * * *